US009322528B2

(12) United States Patent
Scarlata et al.

(10) Patent No.: US 9,322,528 B2
(45) Date of Patent: Apr. 26, 2016

(54) REFLECTOR ARRAYS FOR LIGHTING DEVICES

(71) Applicants: Andrew Francis Scarlata, West Monroe, NY (US); Graig Edmund DeCarr, Cicero, NY (US)

(72) Inventors: Andrew Francis Scarlata, West Monroe, NY (US); Graig Edmund DeCarr, Cicero, NY (US)

(73) Assignee: Cooper Technologies Company, Houston, TX (US)

( * ) Notice: Subject to any disclaimer, the term of this patent is extended or adjusted under 35 U.S.C. 154(b) by 54 days.

(21) Appl. No.: 14/088,193

(22) Filed: Nov. 22, 2013

(65) Prior Publication Data

US 2015/0146421 A1 May 28, 2015

(51) Int. Cl.
*F21V 7/00* (2006.01)

(52) U.S. Cl.
CPC ..... *F21V 7/0083* (2013.01)

(58) Field of Classification Search
CPC ..... F21V 7/0083; F21V 19/001; F21V 7/00–7/22; F21V 14/07; H02H 7/20–7/205
USPC ..... 362/243, 249.02, 235
See application file for complete search history.

(56) References Cited

U.S. PATENT DOCUMENTS

| | | | | |
|---|---|---|---|---|
| 4,254,453 | A * | 3/1981 | Mouyard | G09F 13/22 340/815.54 |
| 7,896,514 | B2 * | 3/2011 | Gomi | 362/97.3 |
| 8,794,787 | B2 * | 8/2014 | Boyer et al. | 362/235 |
| 2009/0257224 | A1 * | 10/2009 | Huang et al. | 362/235 |

* cited by examiner

*Primary Examiner* — Anabel Ton
(74) *Attorney, Agent, or Firm* — King & Spalding LLP

(57) ABSTRACT

A reflector array for a lighting fixture can include at least one reflector section and at least one neutral section. The at least one reflector section can include a number of reflectors, where each reflector has at least one reflector wall having a reflective material and an aperture that traverses the at least one reflector wall, where each aperture is configured to receive a light source disposed on a mounting surface of the lighting fixture. The at least one neutral section can include an electrically non-conductive material, where the at least one neutral section is disposed adjacent to the at least one reflector section.

19 Claims, 8 Drawing Sheets

REFLECTOR ARRAYS FOR LIGHTING DEVICES

TECHNICAL FIELD

Embodiments described herein relate generally to reflector arrays for a lighting device, and more particularly to systems, methods, and devices for a reflector arrays for a LED floodlights.

BACKGROUND

Floodlights are used in many different applications. Such floodlights may be used, for example, in commercial applications and residential applications. Floodlights may also be used in industrial applications and other harsh environments, including but not limited to military applications, onboard ships, assembly plants, power plants, oil refineries, and petrochemical plants. At times, floodlights must comply with one or more standards and/or regulations to ensure safe and reliable operation, and to distribute light in a particular way. With the development of lighting technologies (e.g., light emitting diodes (LEDs)) that offer alternatives to incandescent lamps, high-intensity discharge (HID), and other relevant lamps, floodlights can utilize such lighting technologies.

SUMMARY

In general, in one aspect, the disclosure relates to a reflector array for a lighting fixture. The reflector array can include at least one reflector section having a plurality of reflectors, where each reflector has at least one reflector wall that has a reflective material and an aperture that traverses the at least one reflector wall, where each aperture is configured to receive a light source disposed on a mounting surface of the lighting fixture. The reflector array can also include at least one neutral section having an electrically non-conductive material, where the at least one neutral section is disposed adjacent to the at least one reflector section.

In another aspect, the disclosure can generally relate to a lighting fixture. The lighting fixture can include a mounting surface, and a number of light sources coupled to the mounting surface. The lighting fixture can also include a reflector array. The reflector array of the lighting fixture can include at least one reflector section having a number of reflectors, where each reflector has at least one reflector wall having a reflective material and an aperture that traverses the at least one reflector wall, where each aperture is configured to receive at least one light source of the plurality of light sources. The reflector array of the lighting fixture can also include at least one neutral section having a first non-reflective material, where the at least one neutral section is disposed adjacent to the at least one reflector section, where the at least one neutral section has at least one second coupling feature that couples to the at least one first coupling feature of the mounting surface when the reflector array is mounted on the mounting surface.

In another aspect, the disclosure can generally relate to a lighting fixture. The reflector array can include at least one reflector section having a plurality of reflectors, where each reflector has at least one reflector wall that has a reflective material and an aperture that traverses the at least one reflector wall, where each aperture is configured to receive a light source disposed on a mounting surface of the lighting fixture. The reflector array can also include at least one neutral section having a non-reflective material, where the at least one neutral section is disposed adjacent to the at least one reflector section.

These and other aspects, objects, features, and embodiments will be apparent from the following description and the appended claims.

BRIEF DESCRIPTION OF THE DRAWINGS

The drawings illustrate only example embodiments of reflector arrays for lighting devices and are therefore not to be considered limiting of its scope, as reflector arrays for lighting devices may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
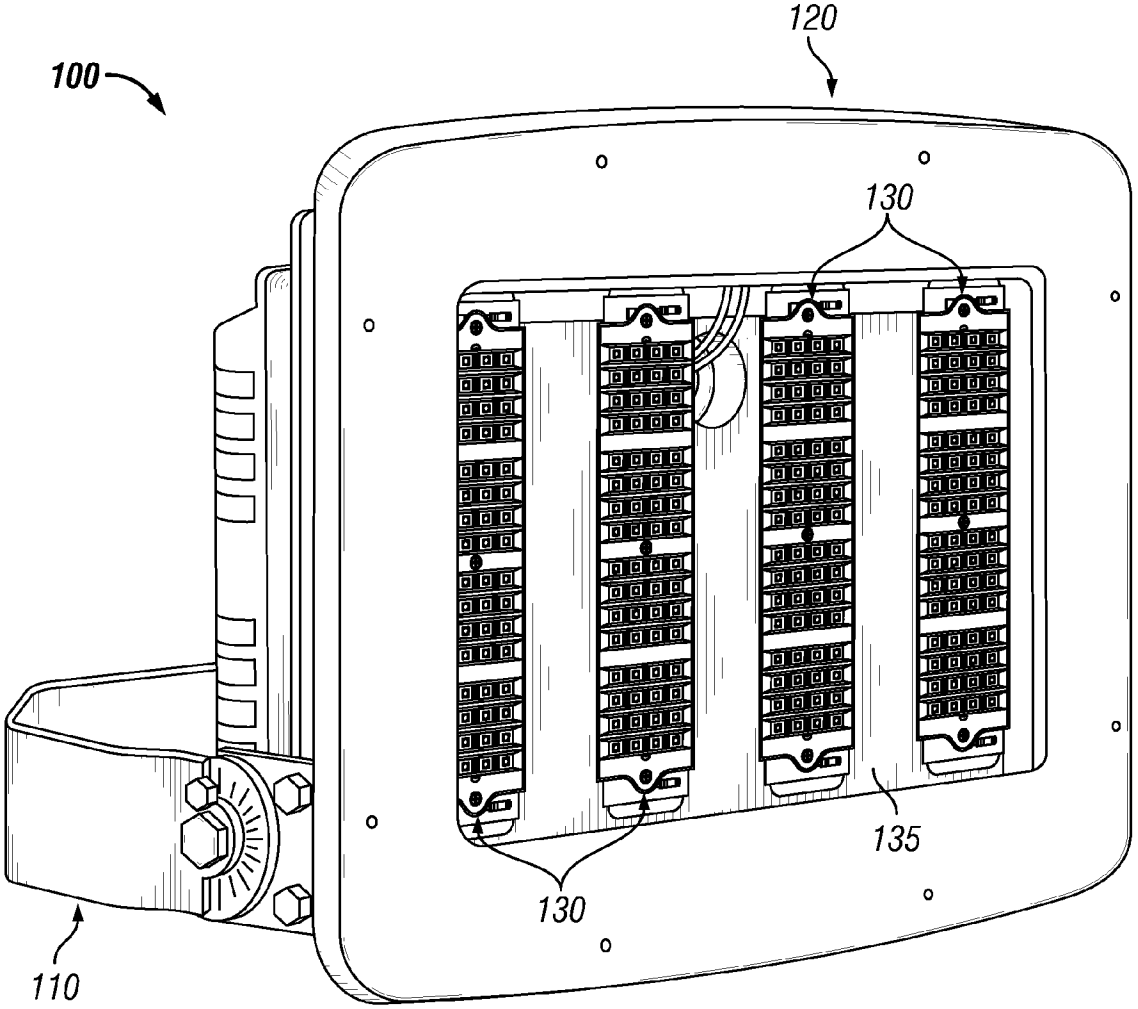
FIG. 1 shows a front perspective view of a LED floodlight using a number of example reflector arrays in accordance with certain example embodiments.

The example embodiments discussed herein are directed to systems, methods, and devices for reflector arrays for lighting devices. While example embodiments are directed herein to LED floodlights, other types of light devices and/or light fixtures can be used with example reflector arrays. Example embodiments can be used with lighting fixtures that are located in a variety of indoor and outdoor environments. As used herein, a lighting fixture (e.g., a LED floodlight) (also sometimes called a light fixture) can be an entire fixture, a part of a fixture (e.g., a module among multiple modules of a fixture), or any other component of a fixture.

In one or more example embodiments, a LED floodlight is subject to meeting certain standards and/or requirements. The International Electrotechnical Commission (IEC) publishes ratings and requirements for LED floodlights. For example, the IEC publishes IP (which stands for Ingress Protection or, alternatively, International Protection) Codes that classify and rate the degree of protection provided against intrusion of solid objects, dust, and water in mechanical casings and electrical enclosures. One such IP Code is IP66, which means that a LED floodlight having such a rating is dust tight and protects against powerful water jets (in this case, 100 liters of water per minute under a pressure of 100 $kN/m^2$ at a distance of 3 meters) for a duration of at least 3 minutes.

The IEC also publishes temperature ratings for electrical equipment. For example, if a device is classified as having a T4 temperature rating, then the surface temperature of the device will not exceed 135° C. Other entities (e.g., the National Electrical Manufacturers Association (NEMA), the National Electric Code (NEC), Underwriters' Laboratories, Inc. (UL)) may also publish standards and/or requirements for LED floodlights.

Example embodiments of LED floodlights (or components thereof, such as the example reflectors described herein) may meet one or more of a number of standards set by one or more of a number of authorities. Examples of such authorities include, but are not limited to, the National Electric Code (NEC), the Canadian Electric Code (CEC), the IEC, the NEMA, Underwriter's Laboratories (UL), the Standards Council of Canada, Conformité Européenne (CE), and the Appareils destinés à être utilisés en Atmosphéres Explosives (ATEX). Examples of such standards include, but are not limited to, Class I, division 2, groups A, B, C, and/or D; Class I, Zone 2; Class II, groups E, F, and/or G; Class III simultaneous presence; Marine and/or Wet locations; Type 4X; IP66; and Ex nA Zone 2.

The example reflector arrays of the floodlights described herein can allow each array to continue to meet such standards and/or regulations. Similarly, example embodiments of reflector arrays used on light fixtures subject to other standards and/or regulations, regardless of the application or industry, allow such light fixtures (or components thereof, such as the reflectors) to continue to meet such standards and/or regulations.

The example reflector arrays (or components thereof) described herein can be made of one or more of a number of suitable materials to allow the reflector arrays to meet certain standards and/or regulations while also maintaining durability in light of the one or more conditions under which the reflector arrays can be exposed. Examples of such materials can include, but are not limited to, aluminum, stainless steel, fiberglass, plastic, nylon, and rubber.

Light sources of a light fixture in which example embodiments described herein can be used can include one or more of a number of different types of light sources, including but not limited to light-emitting diode (LED) light sources, fluorescent light sources, organic LED light sources, incandescent light sources, and halogen light sources. The LED light sources described herein may include any type of LED technology, including, but not limited to, chip on board and discrete die. Therefore, example embodiments of reflector arrays described herein should not be considered limited to a light fixture having a particular type of light source.

A user may be any person that interacts with a light fixture using example embodiments described herein. Specifically, a user may install, maintain, operate, and/or interface with a light fixture using example reflector arrays. Examples of a user may include, but are not limited to, an engineer, an electrician, an instrumentation and controls technician, a mechanic, an operator, a consultant, a contractor, and a manufacturer's representative.

Example embodiments of example reflector arrays for floodlights will be described more fully hereinafter with reference to the accompanying drawings, in which example reflector arrays for floodlights are shown. Reflector arrays may, however, be embodied in many different forms and should not be construed as limited to the example embodiments set forth herein. Rather, these example embodiments are provided so that this disclosure will be thorough and complete, and will fully convey the scope of reflector arrays for floodlights to those or ordinary skill in the art. Like, but not necessarily the same, elements (also sometimes called components) in the various figures are denoted by like reference numerals for consistency. Terms such as "first," "second," "top," "bottom," "left," "right," "front," and "back" are used merely to distinguish one component (or part of a component) from another. Such terms are not meant to denote a preference or a particular orientation.

FIG. 1 shows a front perspective view of a LED floodlight 100 using a number of example reflector arrays in accordance with certain example embodiments. In one or more example embodiments, one or more of the components shown in FIG. 1 may be omitted, repeated, and/or substituted. Accordingly, example embodiments of a LED floodlight (or portions thereof) using example reflector arrays should not be considered limited to the specific arrangements of components shown in FIG. 1.

Referring now to FIG. 1, the LED floodlight 100 can include a mounting assembly 110 and a lighting device 120. The lighting device 120 can include a number of (in this case, four) lighting arrays 130 that are each mounted on a backing member 135. Details of a lighting array 130 are described below with respect to FIGS. 2A and 2B.

Figure 2A:
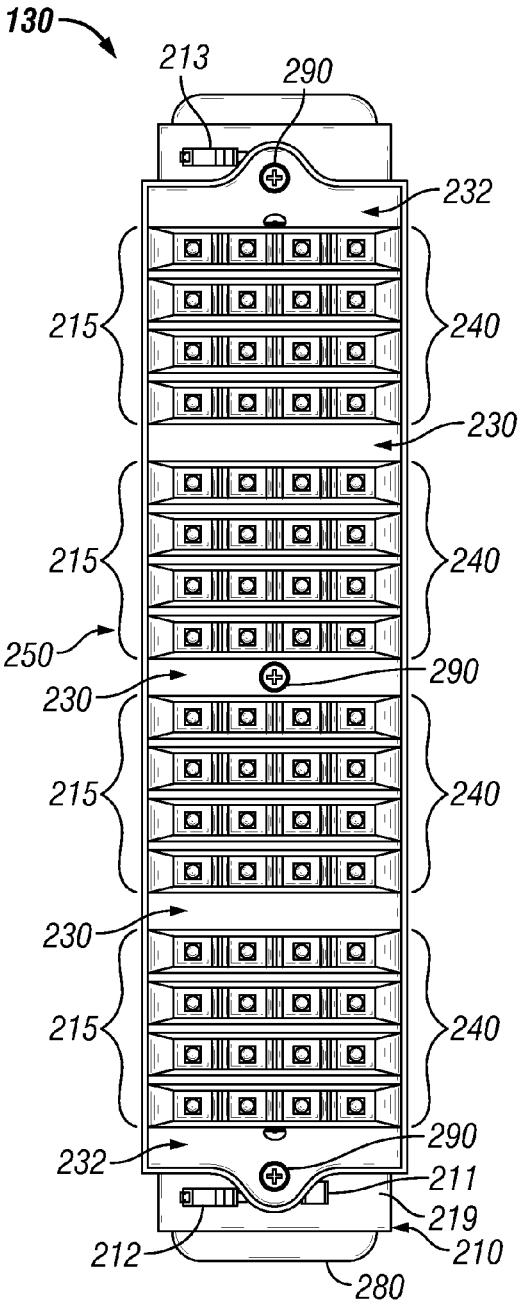
FIGS. 2A and 2B show various front views of a lighting array in accordance with certain example embodiments.
Figure 2B:
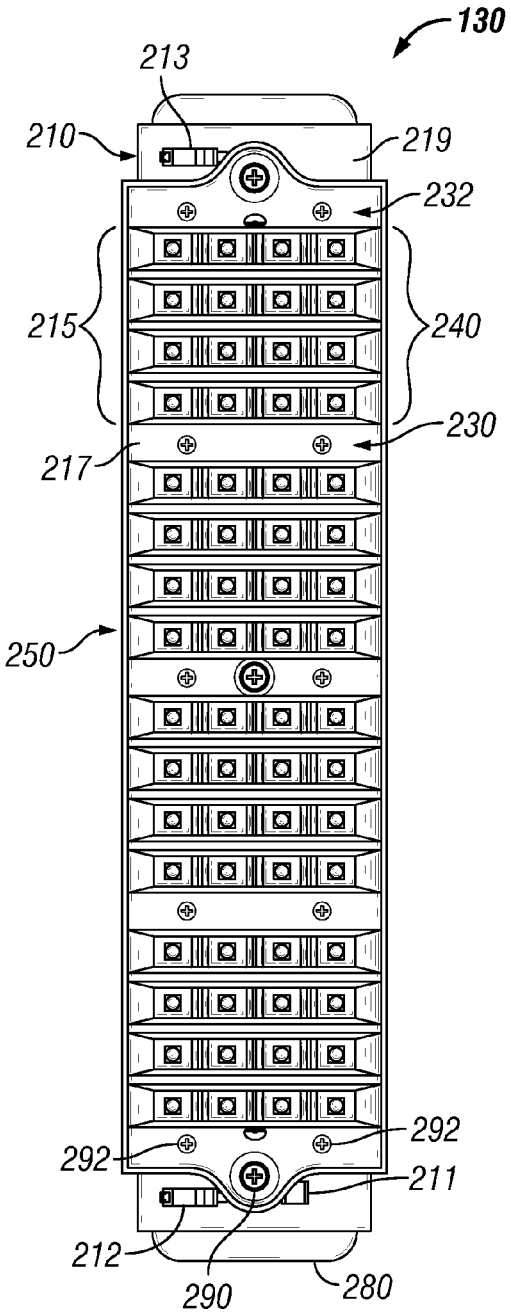

FIGS. 2A and 2B show various front views of a lighting array 130 in accordance with certain example embodiments. Specifically, FIG. 2A shows a front view of the lighting array 130 where the reflector array 250 is non-transparent, while FIG. 2B shows a front view of the lighting array 130 where the reflector array 250 is transparent. In one or more example embodiments, one or more of the components shown in FIGS. 2A and 2B may be omitted, repeated, and/or substituted. Accordingly, example embodiments of a lighting array (or portions thereof) should not be considered limited to the specific arrangements of components shown in FIGS. 2A and 2B.

Referring to FIGS. 1-2B, the lighting array 130 can include a base 280, an optional printed wiring board (PWB) 210, and a reflector array 250. In certain example embodiments, the optional base 280 acts as a heat sink and is thermally coupled to the PWB 210 and/or light assemblies 440 (described below with respect to FIGS. 4A and 4B) in order to absorb heat from the PWB 210 and/or the light assemblies. The base 280 can be a separate component that is mechanically coupled to the backing member 135 (or some other portion of the LED floodlight 100). Alternatively, the base 280 can be integrated with the backing member 135 (or some other portion of the LED floodlight 100) to form a single piece, as made from a cast or mold. Such heat can be generated, for example, by the light assemblies 440 mounted on the PWB 210 or, if there is no PWB 210, on the base 280. The base 280 can be made of one or more of a number of thermally conductive materials, including but not limited to aluminum.

The base 280 can have one or more of a number of coupling features (not shown) that allow the base 280 to mechanically couple to the PWB 210 and/or the backing member 135. Examples of such coupling features can include, but are not limited to, apertures, clips, tabs, and slots. As an example, one or more apertures in the base 280 can align with one or more corresponding apertures in the PWB 210 and have a fastening device 292 (e.g., a screw with a nylon patch for vibration resistance) traverse therethrough to couple the PWB 210 to the base 280. If there is no PWB 210, the base 280 can be directly coupled to the light assemblies 440.

Further, the base 280 can include one or more additional features and/or components that are coupled to the base 280. Such components can be used for additional heat transfer. For example, the base 280 can include a graphite heat-spreading pad disposed on the top surface of the base 280. In such a case, the graphite heat-spreading pad is positioned between the rest of the base 280 and the PWB 210.

In certain example embodiments, the PWB 210 is a medium that includes, and on which are disposed, one or more of a number of discrete components (e.g., capacitor 211, power terminal 212, power terminal 213, resistor, LEDs) and/or one or more integrated circuits that are interconnected with each other by a number of wire traces embedded in the PWB 210. The PWB 210 can be called one or more of a number of other names, including but not limited to a board, a wiring board, a circuit board, and a printed circuit board.

As explained below with respect to FIGS. 4A and 4B, also included with the PWB 210 or the base 280 is one or more light sources. In this case, the light sources are disposed on a top surface 219 of the PWB 210 or the base 280. When the PWB 210 or the base 280 has multiple light sources, as shown in FIGS. 2A and 2B, the light sources can be arranged in one or more of a number of light arrays 215. When there are multiple light arrays 215, each light array 215 can be different (e.g., number of light sources, arrangement of light sources) or substantially the same as the other light arrays 215 of the PWB 210 or the base 280.

Further, when a PWB 210 has multiple light arrays 215, a dividing section 217 can be disposed between each pair of adjacent light arrays 215. Control and/or power signals (e.g., voltage, current) are delivered to the PWB 210 or the base 280 by a power source (e.g., a LED driver (not shown) located within, on, and/or external to the LED floodlight 100. Such power and/or control signals can be used to illuminate the light sources of the PWB 210 or the base 280.

The PWB 210 can have one or more of a number of coupling features (hidden from view by fastening devices 290 and fastening devices 292) that allow the PWB 210 to mechanically couple to the base 280 and/or the reflector array 250. Examples of such coupling features can include, but are not limited to, apertures (as in this example), clips, tabs, and slots. As an example, one or more apertures in the PWB 210 or the base 280 can align with one or more corresponding apertures in the reflector array 250 and have one or more fastening devices 290 (e.g., a nylon screw) traverse therethrough to couple the reflector array 250 to the PWB 210 or the base 280. Some or all of the coupling features of the PWB or the base 280 210 can be located in one or more of the dividing sections 217.

In certain example embodiments, when the PWB 210 exists, the coupling features of the PWB 210 that allow the PWB 210 to mechanically couple to the base 280 are different and distinct from the coupling features of the PWB 210 that allow the reflector array 250 to mechanically couple to the PWB 210. Thus, the coupling features used to couple the PWB 210 to the base 280 are independent of the coupling features used to couple the reflector array 250 to the PWB 210. In such a case, the thermal path contact pressure for the reflector array 250 is independent of the preload between the PWB 210 and the base 280.

The reflector array 250 of the lighting array 130 can be a medium that includes, and on which are disposed, one or more of a number of reflectors, which are described in further detail below with respect to FIGS. 3A and 3B. When the reflector array 250 has multiple reflectors, as shown in FIGS. 2A and 2B, the reflectors can be arranged in one or more of a number of reflector sections 240. When there are multiple reflector sections 240, each reflector section 240 can be different (e.g., number of reflectors, arrangement of reflectors) or substantially the same as the other reflector sections 240 of the reflector array 250.

Further, a reflector array 250 can include one or more neutral sections (e.g., neutral sections 230, neutral sections 232), where each neutral section can be disposed adjacent to a reflector section 240. If there are multiple neutral sections, then each neutral section can be disposed adjacent to and on at least one side of at least one reflector section 240. Each neutral section can be made of an electrically non-conductive and/or a non-reflective material.

Figure 3A:
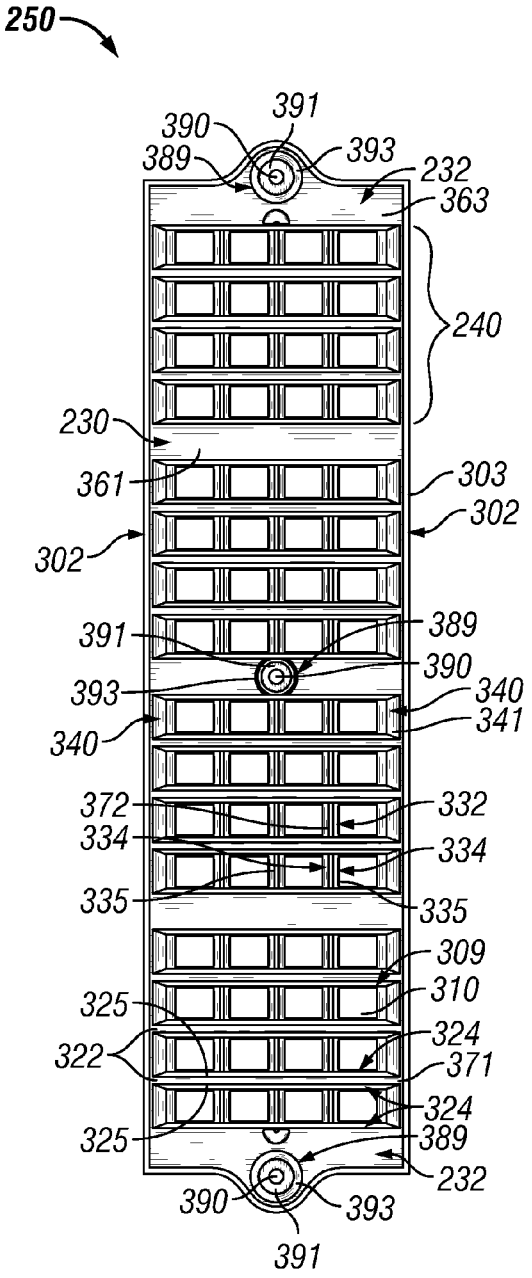
FIGS. 3A and 3B show various views of a reflector array in accordance with certain example embodiments.
Figure 3B:
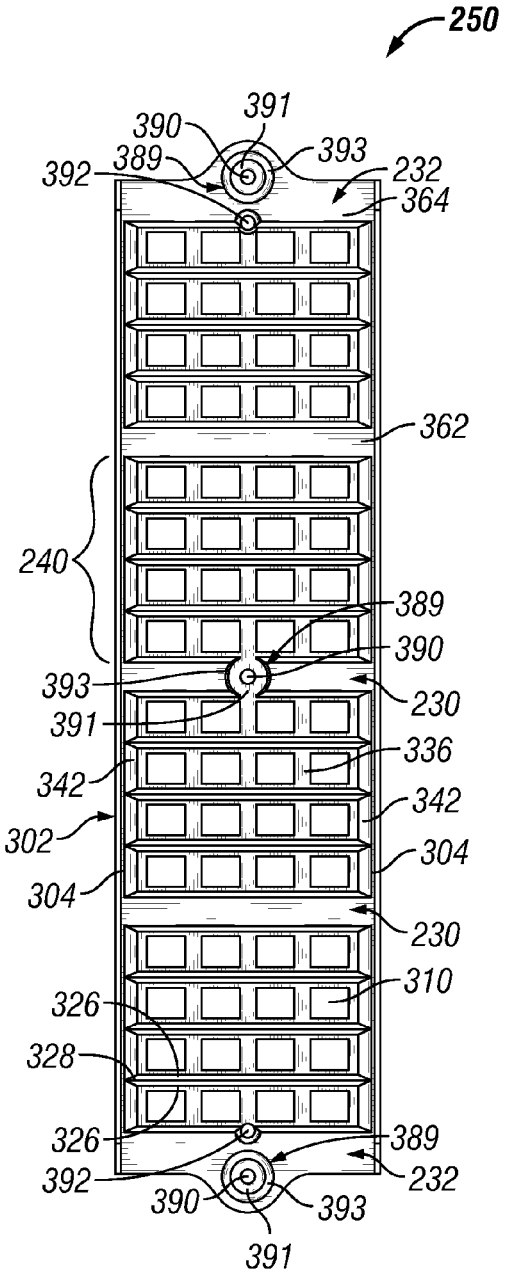

FIGS. 3A and 3B show various views of a reflector array 250 in accordance with certain example embodiments. Specifically, FIG. 3A shows a front view of the reflector array 250, and FIG. 3B shows a rear view of the reflector array 250. In one or more example embodiments, one or more of the components shown in FIGS. 3A and 3B may be omitted, repeated, and/or substituted. Accordingly, example embodiments of a reflector array (or portions thereof) should not be considered limited to the specific arrangement of components shown in FIGS. 3A and 3B.

Referring to FIGS. 1-3B, one or more of the coupling features 389 of the reflector array 250 can have multiple features. For example, each of the coupling features 389 shown in FIGS. 3A and 3B is positioned in a neutral section (e.g., neutral section 230, neutral section 232) and includes an aperture 390 that traverses the entire thickness of the reflector array 250. In addition, each coupling feature 389 can include a recessed portion 391 adjacent to and surrounding the aperture 390. The reflector array 250 can have a thickness between its top surface and its bottom surface. In such a case, the recessed portion 391 can be disposed toward the bottom surface of the reflector array 250. The coupling feature can also include a transition piece 393 adjacent to and surrounding the recessed portion 391. The transition piece 393 can be sloped and provide a bridge between the recessed portion 391 and the top surface of a corresponding neutral section.

FIG. 3B shows an example of another coupling feature 392 of the reflector array 250 that is disposed on the bottom side of the reflector array 250. Specifically, coupling feature 392 can be a standoff that is configured to be disposed within a recessed area (e.g., recessed area 491 in FIGS. 4A and 4B below) on the top surface 219 of the PWB 215 or the base 280. In such a case, the recessed area 491 can be a coupling feature of the PWB 215 or the base 280. The coupling feature 392 can be used to properly align the reflectors of the reflector array 250 with the LEDs that are disposed within the reflectors. The number, size, and/or location of the coupling features 392 and the coupling features 389 on the reflector array 250 can vary.

As stated above, the number and/or size of each reflector section 240 and/or the number of neutral sections 232 of a reflector array 250 can vary. In the example shown in FIGS. 4A and 4B, the reflector array 250 has four reflector sections 240 and a total of five neutral sections (two neutral sections 232 at the top and bottom of the reflector array 250, and three neutral sections 230 disposed at various points in between the neutral sections 232). Each of the three neutral sections 230 is disposed between each two adjacent reflector sections 240. Three of the five neutral sections (in this case, the middle neutral section 230 and both neutral sections 232) include a coupling feature 389, while the other two neutral sections 230 do not have a coupling feature 389. In addition, each of the neutral sections 232 include a coupling feature 392 disposed on its back side.

As described above, each reflector section 240 of the reflector array 250 can have one or more of a number of reflectors 309. If a reflector section 240 has multiple reflectors 309, such reflectors 309 can be arranged in one or more rows, one or more columns, randomly, and/or in any other suitable arrangement. For example, as shown in FIG. 3A, each reflector section 240 has 16 reflectors 309 that are arranged in a grid of four rows and four columns. Each reflector 309 can have one or more reflector walls (e.g., reflector wall 324, reflector wall 340, reflector wall 334). In addition, each reflector 309 has an aperture 310 that traverses the at least one aperture wall. For example, in this case, the aperture 310 of each reflector 309 is disposed in the approximate middle of the reflector 309 where the various reflector walls are joined.

In certain example embodiments, each aperture 310 is configured to receive one or more light sources (described below with respect to FIGS. 4A-6B below) disposed on a PWB 210 or the base 280 of the LED floodlight 100. In such a case, the light source may not come into physical contact with the reflector walls. In some cases, there is no light source disposed within an aperture 310 of a reflector 309, even though the aperture 310 is configured to receive a light source. One or more of the reflector walls (e.g., reflector wall 324, reflector wall 340, reflector wall 334) can be made of and/or coated with a reflective material. The reflective material is designed to reflect and/or otherwise manipulate the light emitted by a light source in a particular manner. Examples of such a reflective material can include, but are not limited to, aluminum and glass (as with a mirror).

Each reflector wall of a reflector 309 can have a top surface and a bottom surface. For example, reflector wall 334 can have a top surface 335 and a bottom surface 336. As another example, reflector wall 324 can have a top surface 325 and a bottom surface 326. As yet another example, reflector wall 340 can have a top surface 341 and a bottom surface 342. In certain example embodiments, the reflective material is only disposed on some or all of the top surface of a reflector wall (e.g., reflector wall 324, reflector wall 340, reflector wall 334), and is not disposed on any part of a bottom surface of a reflector wall for a reflector 309. As a result, the reflective portion of a reflector wall "floats" above (does not come into direct contact with) the various components (e.g., light source receiver, light source) of the PWB 210 or the base 280.

In certain example embodiments, the reflective material disposed on one or more of the reflector walls can be coated with an electrically non-conductive material. In such a case, the coating of the electrically non-conductive material can help prevent or reduce the occurrence of corrosion and/or other harmful conditions from occurring to the reflective material. If a coating of an electrically non-conductive material is used, it may be applied to the portions (e.g., the top surface) of a reflector wall that include the reflective coating rather than to an entire reflector wall or, more specifically, to portions (e.g., on the bottom surface) of a reflector wall that do not have the reflective material disposed thereon.

In certain example embodiments, each reflector 309 is three dimensional. Specifically, in addition to a length and a width, each reflector wall also has a height. In such a case, the height of the reflector wall can approximately correspond to a depth of the reflector array 250. Thus, one or more reflector walls can be planar (flat) and/or have a curved (e.g., concave, convex) surface. Such configuration (e.g., shape, size) of the reflector walls can be set according to a desired light distribution from a light source disposed within the reflector 309. The configuration of the reflector walls of one reflector 309 can be substantially the same as and/or different than the configuration of the corresponding reflector walls of the remaining reflectors 309 in the same and/or any other reflector section 240.

In certain example embodiments, the height of a reflector wall (and, thus, the thickness of a corresponding reflector 309) can be substantially the same as the thickness of the reflector array 250. In such a case, when the reflector array 250 is mechanically coupled to the PWB 210 or the base 280, the bottom surface of the one or more reflector walls of the reflector 309 can physically contact the PWB 210 or the base 280. When the bottom surface of such a reflector is made of electrically non-conductive material, the reflector 309 can reduce or eliminate a voltage potential with an adjacent reflector 309, where the voltage potential is measured between a light source disposed in the aperture 310 of the reflector 309 and another light source disposed in the aperture 310 of the adjacent reflector 309.

In addition, or in the alternative, the bottom surface of such a reflector can be made of thermally non-conductive material. In such a case, the reflector 309 will not disrupt a thermal path of a light source disposed in the aperture 310 of the reflector 309. In such a case, the thermal path is defined, at least in part, by the light source and the base 280. As a result, the thermal path of each light source is secured, substantially unaffected by the reflector 309 of the example reflector array 250.

When there are multiple reflectors 309 in a reflector section 240, each reflector 309 can be positioned adjacent to at least one other reflector 309 in the reflector section 240. In certain example embodiments, each reflector 309 is separated from an adjacent reflector 309 by one or more of a number of dividers (e.g., divider 322, divider 332). In such a case, each divider can be adjacent to one or more reflector walls. For example, as shown in FIG. 3A, divider 322 can be adjacent to reflector wall 324, positioned on each side of the divider 322. As another example, divider 332 can be adjacent to reflector wall 334, positioned on each side of the divider 332. Some or all of the dividers 332 and/or the dividers 334 can be made of reflective material or non-reflective material. Further, some or all of the dividers 332 and/or the dividers 334 can be made of electrically and/or thermally non-conductive material.

In certain example embodiments, as shown in FIGS. 3A and 3B, one or more of the dividers (e.g., divider 322) can have a thickness that is less than the thickness of the reflector array 250. In such a case, the divider can be positioned toward the top side of the reflector array 250. Alternatively, one or more dividers (e.g., divider 332) can have a thickness that is substantially the same as the thickness of the reflector array 250. In any case, each divider can have a top surface and a bottom surface. For example, divider 322 can have a top surface 371 and a bottom surface 328. As another example, divider 332 can have a top surface 372 and a bottom surface 336. In certain example embodiments, some or all of the top surface of a divider can be made of and/or coated with a reflective material.

In certain example embodiments, the reflective material disposed on one or more of the dividers can be coated with an electrically non-conductive material, as described above with respect to the reflector walls. If a coating of an electrically non-conductive material is used, it may be applied to the portions (e.g., the top surface) of a divider that include the reflective coating rather than to an entire divider or, more specifically, to portions (e.g., on the bottom surface) of a divider that do not have the reflective material disposed thereon.

Each reflector 309 can be configured to reflect and distribute light in a substantially similar pattern compared to how the other reflectors in the reflector array 250 are configured to reflect and distribute light. Alternatively, one or more reflectors 309 in a reflector array 250 can be configured to reflect and/or distribute light in a different pattern compared to how one or more other reflectors 309 in the reflector array 250 reflect and distribute light.

In addition, along each side of the reflector array 250 can be disposed an end piece 302. Each end piece 302 can run along some or all of a side of the reflector array 250. An end piece 302 can have a thickness that is substantially the same as the thickness of the reflector array 250. As shown in FIGS. 3A and 3B, the end piece 302 can have a top surface 303 and a bottom surface 304. In certain example embodiments, one or more reflectors walls 340 can be disposed adjacent to an end piece 302. Some or all of each end piece 302 can be made of an electrically and/or thermally non-conductive material. In addition, or in the alternative, each end piece 302 can be made of and/or coated with a non-reflective material. While an end piece 302 may be made of a non-reflective material, some or all of the end piece 302 can be colored white (or nearly white) to reflect any light that strays outside of a reflector 309.

Each neutral section (e.g., neutral section 230, neutral section 232) can have a thickness that is less than the thickness of the reflector array 250. In such a case, the neutral section can be positioned toward the top side of the reflector array 250. Further, each neutral section can have a front surface and a back surface. For example, as shown in FIGS. 3A and 3B, neutral section 230 can have a front surface 361 and a back surface 362. As another example, neutral section 232 can have a front surface 363 and a back surface 364.

Some or all of each neutral section can be made of an electrically and/or thermally non-conductive material. In addition, or in the alternative, some or all of each neutral section can be void of any reflective material. In such a case, because the neutral sections are positioned adjacent to one or more reflector sections 240, the voltage potential along the length of one or more reflector sections 240 and/or the entire reflector array 250 can be lowered compared to when portions of the reflector array 250 have reflective material over most or all of its length. For example, example reflector arrays 250 can have a voltage potential of approximately 50V when measured from top to bottom of the reflector array 250, which compares to approximately 200V, measured from top to bottom, for reflector devices currently used in the art. As a result, using example reflector arrays 250 allows for a closer spacing of light sources on the PWB 210 or the base 280.

In certain example embodiments, the material of the neutral sections is substantially the same as the material of the end pieces 302. While a neutral section may be made of a non-reflective material, some or all of the neutral section can be colored white (or nearly white) to reflect any light that strays outside of a reflector 309.

Figure 4A:
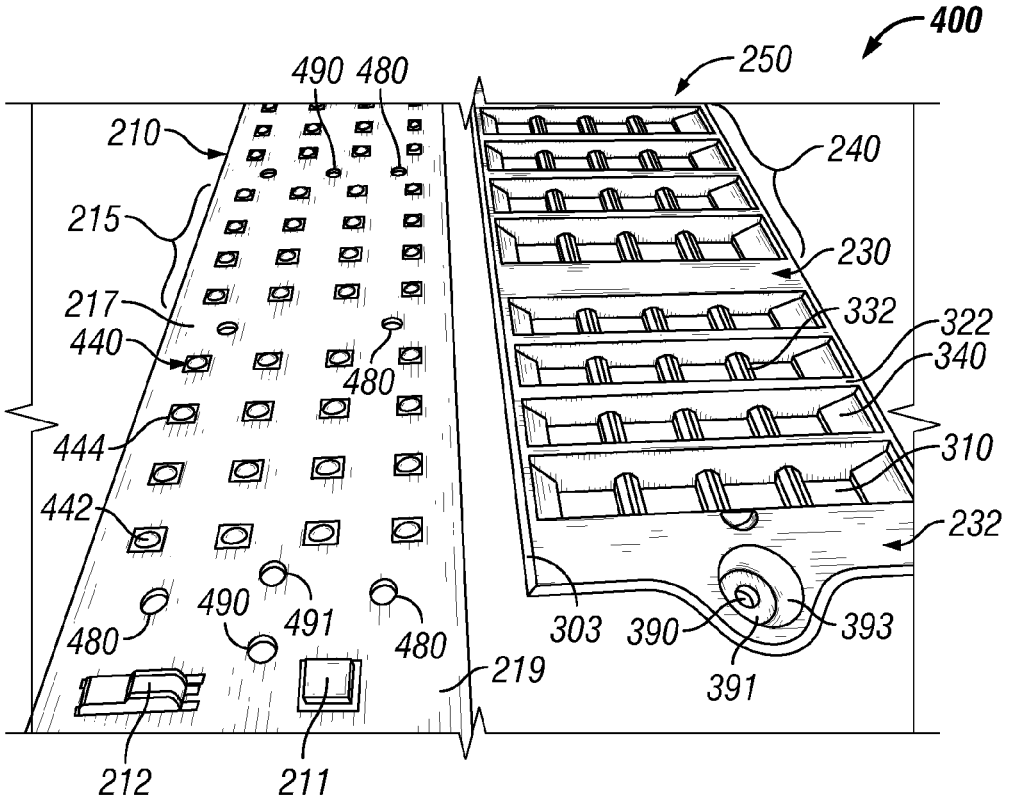
FIGS. 4A and 4B show various views of a reflector array and printed wiring board in accordance with certain example embodiments.
Figure 4B:
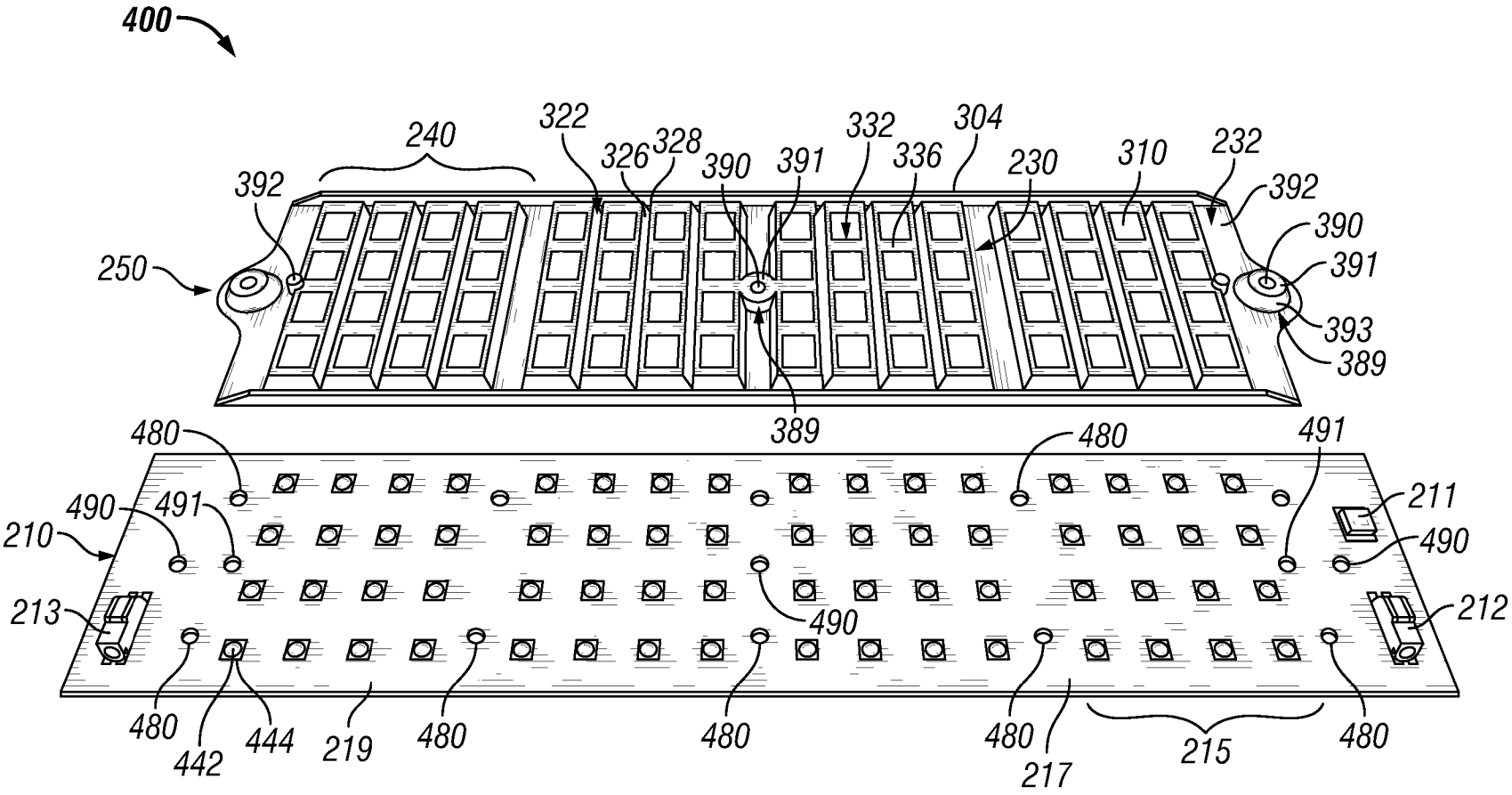

FIGS. 4A and 4B show various perspective views of a subsystem 400 that includes a reflector array 250 and a PWB 210 in accordance with certain example embodiments. In FIG. 4A, the top surface 219 of the PWB 210 is visible along with the top side of the reflector array 250. In FIG. 4B, the top surface 219 of the PWB 210 is visible along with the bottom side of the reflector array 250. In one or more example embodiments, one or more of the components shown in FIGS. 4A and 4B may be omitted, repeated, and/or substituted. Accordingly, example embodiments of a reflector array and PWB or base should not be considered limited to the specific arrangements of components shown in FIGS. 4A and 4B. Further, labels not shown in FIGS. 4A and 4B but referred to with respect to FIGS. 4A and 4B can be incorporated by reference from FIGS. 1-3B. Similarly, a description of a label shown in FIGS. 4A and 4B but not described with respect to FIGS. 4A and 4B can use the description from FIGS. 1-3B.

Referring to FIGS. 1-4B, The PWB 210 includes a number of light assemblies 440. The components and/or configuration of each light assembly 440 can vary. For example, as shown in FIGS. 4A and 4B, each light assembly 440 can include one or more light sources 442 mounted on one or more light source receivers 444. Also, the number and/or layout of the light assemblies 440 can vary. In FIGS. 4A and 4B, there are 64 light assemblies 440. Specifically, the PWB 210 of FIGS. 4A and 4B has four light arrays 215 that are each substantially identical to each other. In this case, each light array 215 has 16 light assemblies 440 arranged in a grid of four rows and four columns.

In other words, the arrangement of the light assemblies 440 of each light array 215 of the PWB 210 is substantially similar to the arrangement of reflectors 309 of each reflector section 240 of the reflector array 250. As a result, when the reflector array 250 is mechanically coupled to the PWB 210, each aperture 310 of the reflectors 309 can receive a light source 442 (or at least a portion) of a light assembly 440 mounted on the PWB 210. As explained below with respect to FIG. 6B, in some example embodiments, not every aperture 310 of a reflector 309 receives at least a portion of a light assembly 440.

The light assemblies 440 in a light array 215 can be electrically coupled to each other. For example, the light assemblies 440 in a light array 215 can be series-connected in some way (e.g., row-to-row serpentine, column-to-column serpentine). Further, one or more light assemblies 440 in one light array 215 can be electrically coupled to one or more light assemblies 440 in another (e.g., an adjacent) light array 215 so that a single feed of power to a PWB 210 (or, in the absence of a PWB 210, a grouping of light arrays 215 and/or light assemblies 440) can provide sufficient power to all light assemblies disposed on the PWB 210.

As discussed above, the PWB 210 and the reflector array 250 couple to each other using one or more coupling features (e.g., coupling feature 490, coupling feature 491) of the PWB 210 in conjunction with one or more coupling features (e.g., coupling feature 389, coupling feature 392) of the reflector array 250. In this case, coupling features 490 and coupling features 389 are apertures in the PWB 210 and reflector array 250, respectively, that are traversed by fastening devices 290. Similarly, coupling features 491 are apertures into which are disposed coupling features 392.

In addition, as discussed above, the PWB 210 can include one or more other coupling features 480 that allow the PWB 210 to mechanically couple to the base 280 and/or some other component of the LED floodlight 100. In this example, the coupling features 480 of the PWB 210 are apertures through which fastening devices 292 traverse.

As stated above, the PWB 210 can be omitted from the LED floodlight 100. Thus, as can be described herein, the component of the LED floodlight 100 on which the light assemblies 440 are mounted can be called a mounting surface, which can include a PWB 210, a base 280, and/or a backing member 135. This mounting surface can also include the coupling features 480, coupling features 490, and/or coupling features 491.

Figure 5A:
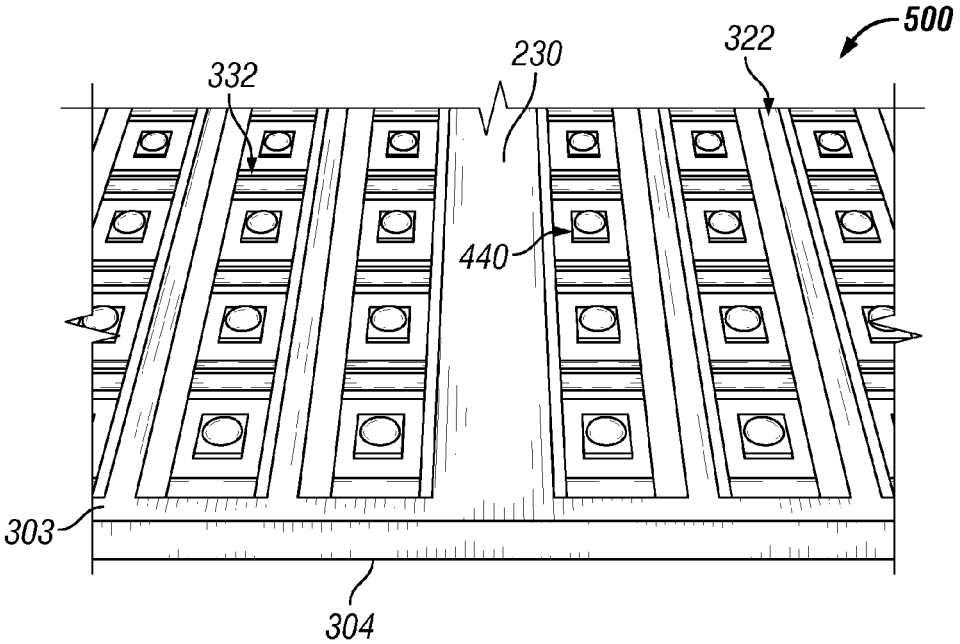
FIGS. 5A-5C show various views of a reflector array and printed wiring board in accordance with certain example embodiments.
Figure 5B:
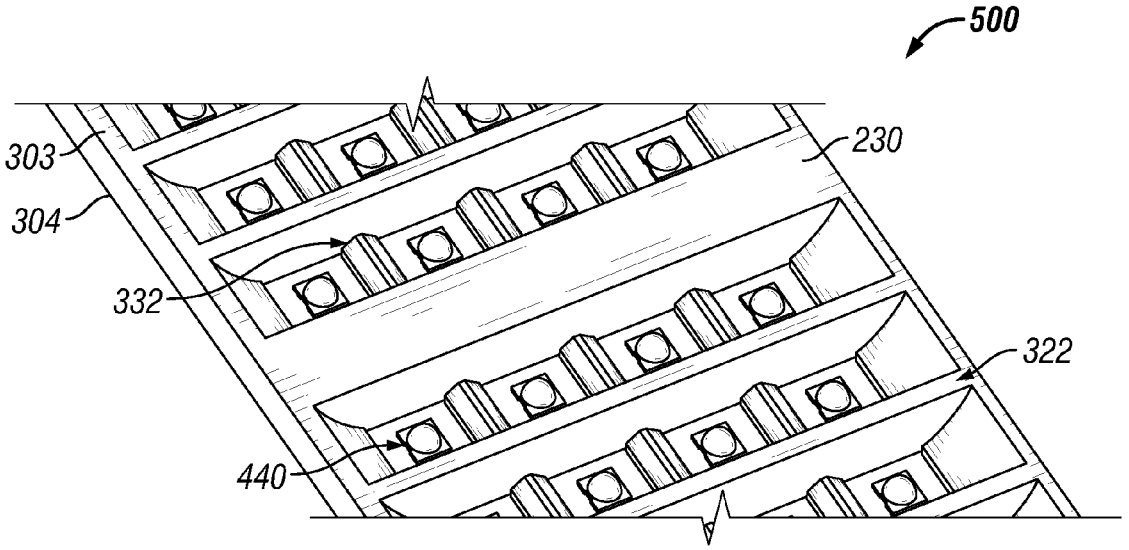
Figure 5C:
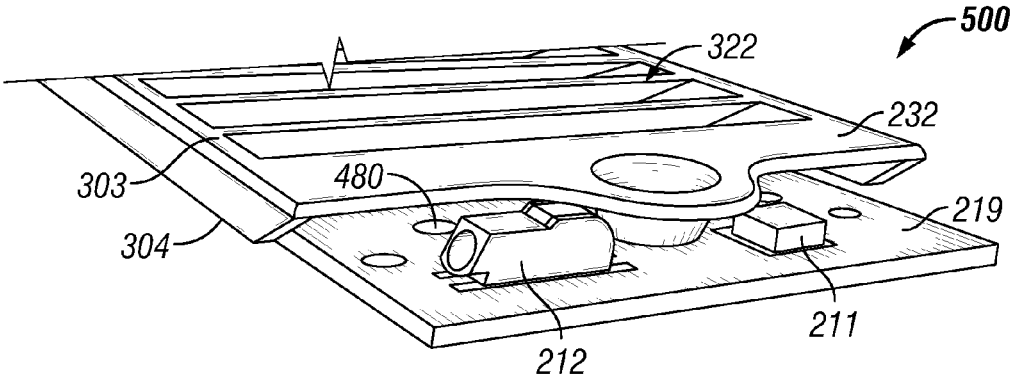

FIGS. 5A-5C show various perspective views of a subsystem 500 that includes the reflector array 250 and the PWB 210, as shown in FIGS. 4A and 4B, in accordance with certain example embodiments. Specifically, the reflector array 250 and the PWB 210 of FIGS. 5A-5C are mechanically coupled to each other. In one or more example embodiments, one or more of the components shown in FIGS. 5A-5C may be omitted, repeated, and/or substituted. Accordingly, example embodiments of a reflector array and a PWB should not be considered limited to the specific arrangement of components shown in FIGS. 5A-5C. Further, labels not shown in FIGS. 5A-5C but referred to with respect to FIGS. 5A-5C can be incorporated by reference from FIGS. 1-4B. Similarly, a description of a label shown in FIGS. 5A-5C but not described with respect to FIGS. 5A-5C can use the description from FIGS. 1-4B.

Referring to FIGS. 1-5C, the light source 442 and the light source receiver 444 of each light assembly 440 can clearly be seen disposed inside an aperture 310 of each reflector 309. In other words, at least a portion of a light assembly 440 is disposed within the aperture 310 of a reflector 309. The depth of each reflector 309, as well as the reflector array 250 in general, can help to maintain a thermal and electrical path between light sources 442.

Figure 6A:
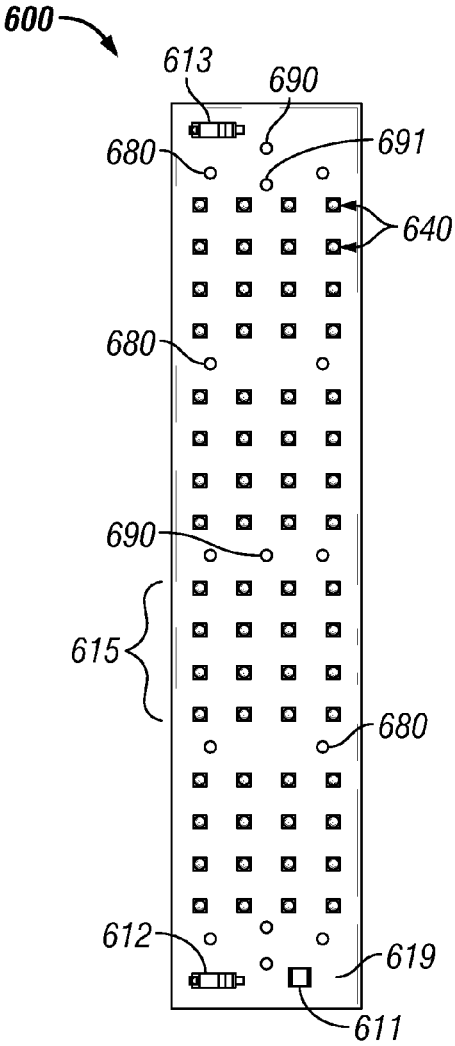
FIGS. 6A and 6B show a front view of various printed wiring boards that can be used with an example reflector array in accordance with certain example embodiments.
Figure 6B:
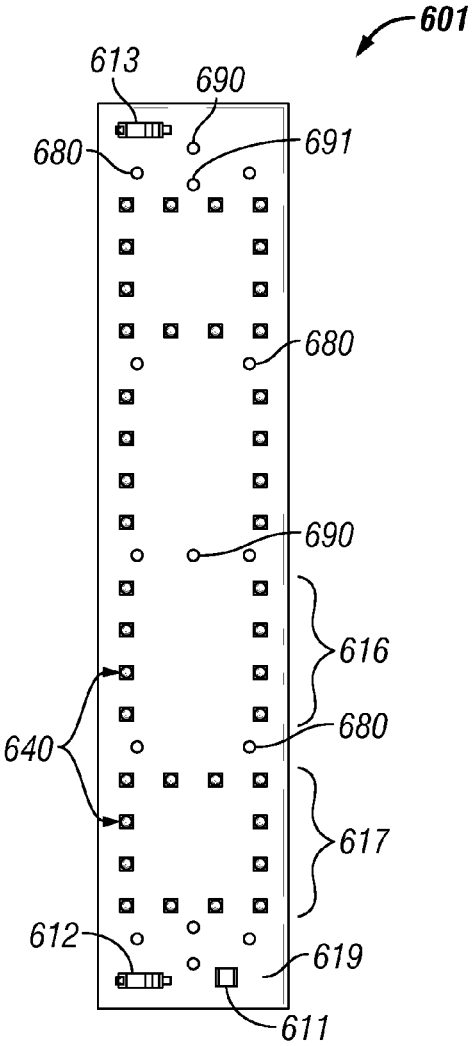

FIGS. 6A and 6B show a front view of various PWBs (or, alternatively, bases) that can be used with an example reflector array in accordance with certain example embodiments. Specifically, FIG. 6A shows a PWB 600 that has one configuration of light assemblies 640, while FIG. 6B shows a different PWB 601 that has a different configuration of light assemblies 640. In one or more example embodiments, one or more of the components shown in FIGS. 6A and 6B may be omitted, repeated, and/or substituted. Accordingly, example embodiments of a PWB should not be considered limited to the specific arrangement of components shown in FIGS. 6A and 6B. Further, labels not shown in FIGS. 6A and 6B but referred to with respect to FIGS. 6A and 6B can be incorporated by reference from FIGS. 1-5B. Similarly, a description of a label shown in FIGS. 6A and 6B but not described with respect to FIGS. 6A and 6B can use the description from FIGS. 1-5B.

The PWB 600 of FIG. 6A and the PWB 601 of FIG. 6B are substantially the same as the PWB 210 of FIGS. 2A, 2B, and 4A-5C, except as described below. The description for any component (e.g., power terminal 612, light assemblies 640) of FIGS. 6A and 6B not provided below can be considered substantially the same as the corresponding component (e.g., power terminal 212, light assemblies 440) described above with respect to FIGS. 2A, 2B, and 4A-5C. The numbering scheme for the components of FIGS. 6A and 6B parallel the numbering scheme for the components of FIGS. 2A, 2B, and 4A-5C in that each component is a three digit number, where similar components between the PWBs of FIGS. 6A and 6B and the PWB 210 have the identical last two digits.

The PWB 600 of FIG. 6A has four light arrays 615, where each light array 615 has 16 light assemblies 640 arranged in a grid of four rows by four columns. By contrast, the PWB 601 of FIG. 6B has two light arrays 616 and two light arrays 617. The light arrays 616 are the middle two in the vertical stack of four light arrays. The light arrays 616 each have a total of 8 light assemblies 640 in two separate columns of four light assemblies 640 disposed along the outer edges of the PWB 601.

The light arrays 617 are the outer-most in the vertical stack of four light arrays. The light arrays 617 each have a total of 12 light assemblies 640. The 12 light assemblies 640 in each light array 617 are arranged along the outer perimeter of the light array 617. Put another way, the light assemblies 640 of each light array 617 are arranged such that eight of the light assemblies 640 form two separate columns of four light assemblies 640 disposed along the outer edges of the PWB 601. In addition, two light assemblies 640 are disposed along the top edge of the light array 617, spaced equidistantly from the top most light assemblies 640 of the columns of four light assemblies 640, and two light assemblies 640 are disposed along the bottom edge of the light array 617, spaced equidistantly from the bottom most light assemblies 640 of the columns of four light assemblies 640.

The quantity, dimensions, and/or orientation of the components of the reflector array 250, as well as any other components of the LED floodlight 100, may vary. For example, the thickness of the reflector array 250 can be approximately 7/32 of an inch, the width of the reflector array 250 can be approximately 3.25 inches, and the height of the reflector array 250 can be approximately 9.125 inches. In such a case, the height of each neutral section 230 positioned between two reflector sections 240 can be approximately 5/16 of an inch, and the height of each neutral section 232 positioned at the top and bottom of the reflector array 250 can be approximately 7/16 of an inch. In addition, Each reflector section 240 can have a height of approximately 1 21/32 inches and a width of approximately 2 1/8 inches, while each reflector 309 can have a height of approximately 11/32 of an inch and a width of approximately 15/32 of an inch for reflectors 309 that are not adjacent to an end piece 302 and approximately 19-32 of an inch for reflectors 309 that are adjacent to an end piece 302. Further, as described above, other quantities and/or orientations of the reflectors 309 and/or the light assemblies 440, may be used in example embodiments.

The example reflector arrays 250 described herein are scalable. In other words, the light emitted by each light source 642 of a light assembly 640 on a PWB (e.g., PWB 600, PWB 601) is given off in the same distribution by the reflectors 309. Put another way, whether the light sources 642 are configured as shown on the PWB 600, as shown on PWB 601, or in any other configuration on a PWB, the light generated by each light source 642 and distributed by the reflector walls of each reflector 309 meet whatever applicable standard may apply. The light projected by the example reflector array 250 is substantially uniform, regardless of the quantity and/or position of the light sources 642.

As an example, light emitted from each light source 642 positioned within one of the reflectors 309 of an example reflector array 250 can comply with American National Standards Institute (ANSI) standard C136.32-2012. The aforementioned ANSI standard is endorsed by NEMA and is sometimes called a NEMA pattern by those skilled in the art. Examples of such NEMA patterns can include, but are not limited to, a NEMA 7×6 pattern, a NEMA 6×6 pattern, a NEMS 7×7 pattern, and a NEMA 3×3 pattern. These NEMA pattern can vary based on the configuration of the reflector walls of a reflector 309.

Figure 7B:
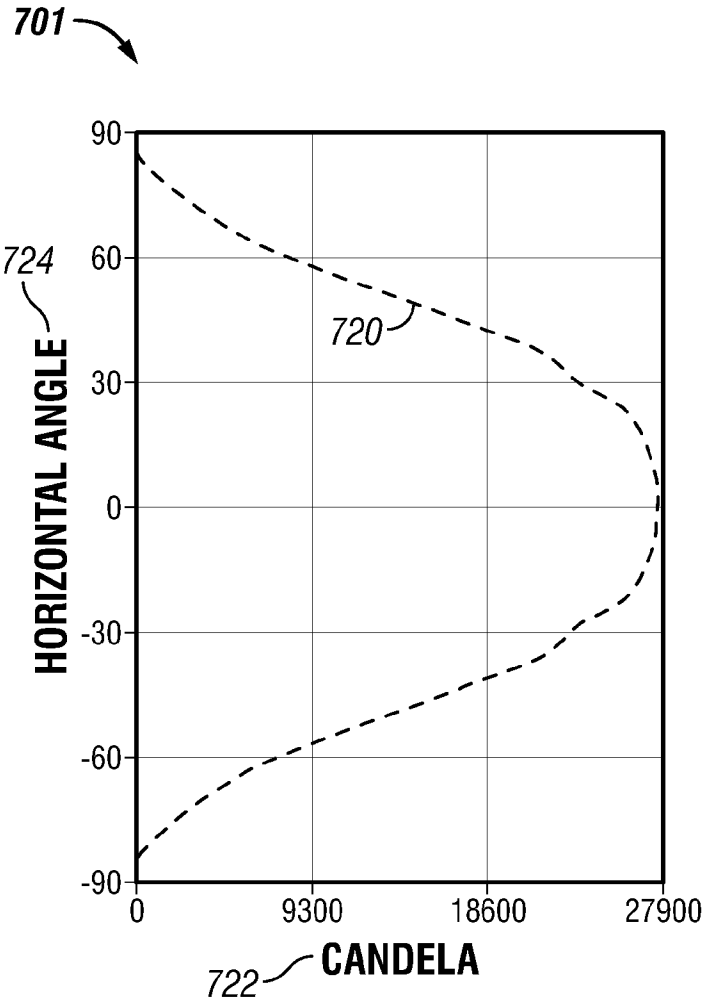
FIGS. 7A and 7B show graphs of light distribution patterns that can be achieved using example embodiments described herein.
Figure 7A:
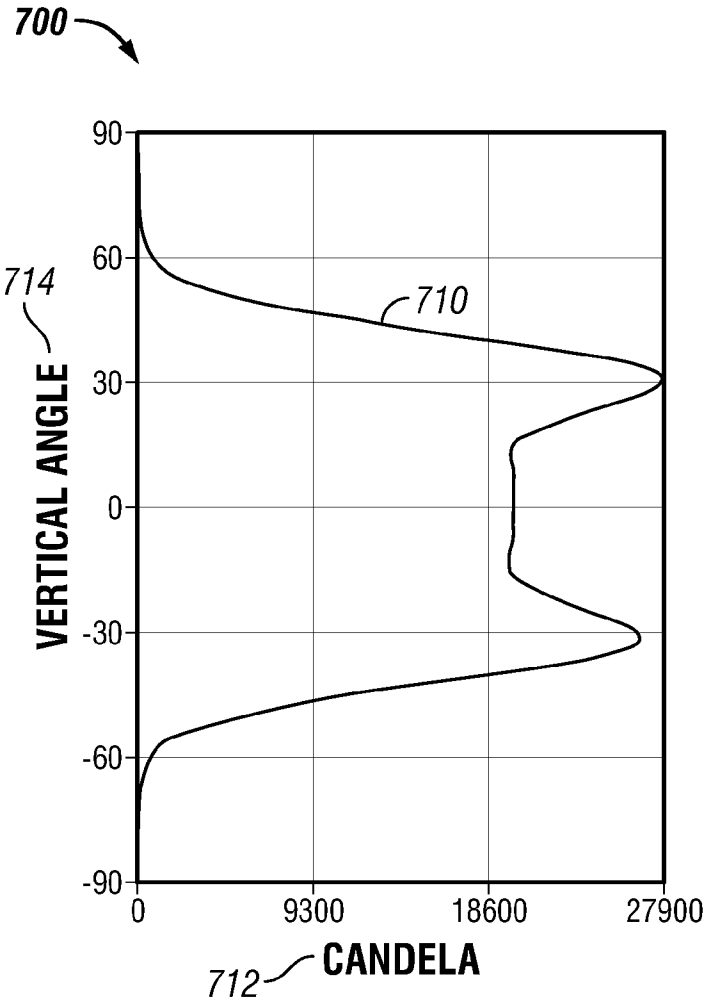

An example of a light distribution pattern using example embodiments is shown in FIGS. 7A and 7B. Specifically, FIGS. 7A and 7B show graphs of light distribution patterns that can be achieved using example embodiments described herein. FIG. 7A shows a graph 700 of light distribution 710 in terms of candelas 712 along various vertical angles 714. FIG. 7B shows a graph 701 of light distribution 720 in terms of candelas 722 along various horizontal angles 724.

In one or more example embodiments, example reflector arrays described herein can be used to more efficiently and effectively distribute light generated by one or more light sources of a lighting fixture, such as a LED floodlight. The example reflector array allows for specific light distribution of each light source, regardless of the quantity and/or orientation of the light sources. The reflector arrays described herein have resistive, thermal, and reflective properties that allow the light sources to be positioned more closely together. Example embodiments also reduce the voltage potential through the interconnected light sources. Further, example embodiments allow the heat path of each light source to remain secure. One or more light distribution standards can be met using example embodiments described herein.

Accordingly, many modifications and other embodiments set forth herein will come to mind to one skilled in the art to which reflector arrays pertain having the benefit of the teachings presented in the foregoing descriptions and the associated drawings. Therefore, it is to be understood that reflector arrays are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A reflector array for a lighting fixture, the reflector array comprising:

a plurality of reflector sections comprising:

a first reflector section comprising a plurality of first reflectors, wherein each first reflector of the plurality of first reflectors comprises at least one first reflector wall comprising a reflective material and a first aperture that traverses the at least one first reflector wall, wherein each first aperture is configured to receive a first light source disposed on a first mounting surface of the lighting fixture, wherein each first reflector comprises an electrically conductive material, wherein a first voltage potential is induced by at least one first light source configured to be disposed within the first aperture of each first reflector; and a second reflector section comprising a plurality of second reflectors, wherein each second reflector of the plurality of second reflectors comprises at least one second reflector wall comprising the reflective material and a second aperture that traverses the at least one second reflector wall, wherein each second aperture is configured to receive a second light source disposed on a second mounting surface of the lighting fixture, wherein each second reflector comprises the electrically conductive material, wherein a second voltage potential is induced by at least one second light source configured to be disposed within the second aperture of each second reflector; and a first neutral section comprising an electrically non-conductive material, wherein the first neutral section is disposed adjacent to and between the first reflector section and the second reflector section, wherein the first neutral section substantially isolates the first voltage potential to the first reflector section, and wherein the first neutral section substantially isolates the second voltage potential to the second reflector section.

2. The reflector array of claim 1, wherein a first reflector wall of the at least one first reflector wall of the plurality of first reflectors has a shape and a size that is substantially similar to the shape and the size of a remainder of first reflector walls of the plurality of first reflectors.

3. The reflector array of claim 1, wherein each first reflector of the plurality of first reflectors is positioned adjacent to at least one other first reflector of the plurality of first reflectors.

4. The reflector array of claim 1, wherein the first voltage potential is measured between a first light source disposed in a first aperture of a first reflector of the plurality of first reflectors and a another first light source disposed in another first aperture of another first reflector of the plurality of first reflectors, wherein the first light source and the another first light source are at either end of a number of series-connected first light sources disposed in the first reflector section.

5. The reflector array of claim 1, wherein first reflector section and the second reflector section maintain electrical isolation from the first neutral section.

6. The reflector array of claim 1, wherein each first reflector of the plurality of first reflectors fails to disrupt a thermal path of the first light source disposed in the respective first aperture of the first reflector.

7. The reflector array of claim 1, wherein each first reflector of the plurality of first reflectors is separated from an adjacent first reflector by a divider.

8. The reflector array of claim 7, wherein the divider is reflective.

9. The reflector array of claim 1, wherein the reflective material of the plurality of first reflectors is coated with an electrically non-conductive material.

10. The reflector array of claim 1, wherein the first neutral section comprises at least one coupling feature, wherein the at least one coupling feature is configured to mechanically couple to the mounting surface of the lighting fixture.

11. The reflector array of claim 1, wherein the first neutral section further comprises a non-reflective material.

12. The reflector array of claim 1, wherein the at least one first reflector wall comprises a top surface and a bottom surface, wherein the top surface comprises the reflective material, and wherein the bottom surface comprises a non-reflective material.

13. A lighting fixture, comprising:

a mounting surface comprising at least one first coupling feature;

a plurality of light sources coupled to the mounting surface; and a reflector array comprising:

at least one reflector section comprising a plurality of reflectors, wherein each reflector of the plurality of reflectors comprises at least one reflector wall comprising a reflective material and has an aperture that traverses the at least one reflector wall, wherein each aperture is configured to receive at least one light source of the plurality of light sources; and at least one neutral section comprising an electrically non-conductive material, wherein the at least one neutral section is disposed adjacent to the at least one reflector section, wherein the at least one neutral section comprises at least one second coupling feature that couples to the at least one first coupling feature of the mounting surface when the reflector array is mounted on the mounting surface.

14. The lighting fixture of claim 13, wherein the one light source is disposed within the aperture of a corresponding reflector when the reflector array is mechanically coupled to the mounting surface.

15. The lighting fixture of claim 13, wherein the plurality of reflectors is at least as numerous as the plurality of light sources.

16. The lighting fixture of claim 13, wherein light emitted from each light source positioned within one of the plurality of reflectors complies with American National Standards Institute standard C136.32-2012.

17. The lighting fixture of claim 13, wherein the mounting surface and the reflector array are coupled to each other using at least one fastening device that engages the at least one first coupling feature of the mounting surface and the at least one second coupling feature of the reflector array, wherein the mounting surface and the reflector array remain coupled to each other when exposed to vibrations.

18. The lighting fixture of claim 13, further comprising:

a base positioned under the mounting surface and comprising at least one third coupling feature, wherein the mounting surface further comprises at least one fourth coupling feature, wherein the at least one third coupling feature of the base couples to the at least one fourth coupling feature of the mounting surface when the mounting surface is mounted on the base.

19. A reflector array for a lighting fixture, the reflector array comprising:

at least one reflector section comprising a plurality of reflectors in a plurality of reflector rows, wherein each reflector of the plurality of reflectors comprises at least one reflector wall comprising a reflective material and an aperture that traverses the at least one reflector wall, wherein each aperture is configured to receive a light source disposed on a mounting surface of the lighting fixture; and at least one divider disposed between a first reflector row and a second reflector row of the plurality of reflector rows of the at least one reflector section, wherein the at least one divider comprises an electrically non-conductive material, wherein the at least one divider limits a voltage potential between the first reflector row and the second reflector row in the at least one reflector section.

* * * * *